United States Patent [19]

Cleveland et al.

[11] 4,300,627

[45] Nov. 17, 1981

[54] INSULATED HOUSING FOR CERAMIC HEAT RECUPERATORS AND ASSEMBLY

[76] Inventors: Joseph J. Cleveland, Box 10B, Boxer Dr., Dushore, Pa. 18614; Ray L. Newman, Hillcrest Dr., R.D. #1, Towanda, Pa. 18848; William L. Mingos, Box 22, Main St., E., Smithfield, Pa. 18817

[21] Appl. No.: 45,492

[22] Filed: Jun. 4, 1979

[51] Int. Cl.[3] ..... F28F 7/00

[52] U.S. Cl. ..... 165/137; 165/166

[58] Field of Search ..... 165/80, 81, 82, 76, 165/166, 135, 136, 165, 167

[56] References Cited

U.S. PATENT DOCUMENTS

| | | | |
|---|---|---|---|
| 3,814,174 | 6/1974 | Beggs | 165/135 |
| 4,083,400 | 4/1978 | Dziedzic et al. | 165/165 |
| 4,168,737 | 9/1979 | Yoshimitsu | 165/165 |

FOREIGN PATENT DOCUMENTS

| | | | |
|---|---|---|---|
| 158127 | 3/1954 | Australia | 165/166 |
| 2453961 | 5/1976 | Fed. Rep. of Germany | 165/81 |
| 1329409 | 7/1963 | France | 165/166 |

*Primary Examiner*—Samuel Scott
*Assistant Examiner*—G. Anderson

[57] ABSTRACT

Cross-flow ceramic recuperators are useful in industrial waste heat recovery in an assembly in which the ceramic recuperator is held by a metallic housing adapted for retrofitting to the metallic fittings of existing furnaces, ovens and preheaters. The assembly is characterized by at least two insulating layers inside the conduit portions leading from the operating hot faces of the ceramic core, whereby the operating efficiency of the assembly is increased.

8 Claims, 4 Drawing Figures

INSULATED HOUSING FOR CERAMIC HEAT RECUPERATORS AND ASSEMBLY

TECHNICAL FIELD

This invention relates to a housing for industrial heat recuperators, and more particularly relates to an insulated housing and a recuperator assembly of a ceramic cross-flow heat recuperator in such a housing for use on furnaces, ovens and preheaters.

BACKGROUND ART

Ceramic recuperators for industrial waste heat recovery have several advantages over conventional metallic recuperators. For example, ceramics in general have high corrosion resistance, high mechanical strength at elevated temperatures, low thermal expansion coefficients (TEC'S) and good thermal shock resistance and thus exhibit excellent endurance under thermal cycling; are light in weight (about ⅓ the weight of stainless steel); and are cost competitive with high temperature alloys. Furthermore, ceramic recuperators are available in a variety of shapes, sizes, hydraulic diameters, (hydraulic diameter is a measure of cross-sectional area divided by wetted perimeter) and compositions.

To render such ceramic recuperators compatible with existing furnace, oven and preheater structures, special housings have been designed.

In U.S. Pat. No. 4,083,400, issued Apr. 11, 1978 and assigned to the present assignee, a ceramic cross-flow recuperator core is incorporated into a metallic housing adapted for retrofitting to the metallic fittings of existing furnaces, ovens and preheaters. Insulating and resilient sealing layers between the core and housing minimize heat loss through the metallic housing and prevent leakage of heat transfer fluids, such as exhaust flue gasses and incoming combustion air, past the core.

In U.S. patent application Ser. No. 951,438, filed Oct. 16, 1978 and assigned to the present assignee, a housing for a ceramic flow recuperator comprises two pairs of opposing apertured plates with means for maintaining the plates in firm contact with the inlet and outlet faces of the ceramic recuperator. These plates, as well as the ceramic faces, may easily be machined to close-tolerance flat surfaces for optimum sealing contact, thus enabling minimization of gas leakage past the ceramic-metal seal. Metal conduits extend a short distance from the plates' external surfaces opposite the contact surfaces, and are adapted for connection to heat transfer fluid conduits.

In both of the above designs, the conduit portions are generally tapered inwardly in a direction away from the housing to the point of connection with the external fluid conduits in order to coincide with the somewhat smaller cross-sections of such conduits as compared to the ceramic recuperator faces. Such tapering requires greater conduit wall area than would a cylindrical design, and thus leads to greater through-wall heat loss.

DISCLOSURE OF INVENTION

According to the invention, a metallic housing is provided for a ceramic recuperator, the housing having at least three conduit portions extending from the external faces of the housing to provide communication between the ceramic recuperator operating faces and external fluid conduits, and at least the two conduit portions which are adjacent to the operating hot faces of the ceramic recuperator core being insulated such as by ceramic layers contacting the inner surfaces of such conduit portions.

In a preferred embodiment, at least one of the insulated conduit portions has at least one dimension of its largest cross-section somewhat larger than the housing face from which it extends, thereby accommodating a substantial thickness of insulation without unduly restricting flow past the hot face of the ceramic recuperator.

In another preferred embodiment, a ceramic insulating layer is tapered inwardly toward the housing face, in order to allow maximum flow past the hot face of the ceramic recuperator while maintaining maximum thickness of liner at the small end of the conduit portion.

The recuperator assembly is useful, for example, to preheat incoming heating or combustion air and/or fuel and thus increase the efficiency of existing furnaces, ovens and preheaters of varying types and sizes.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
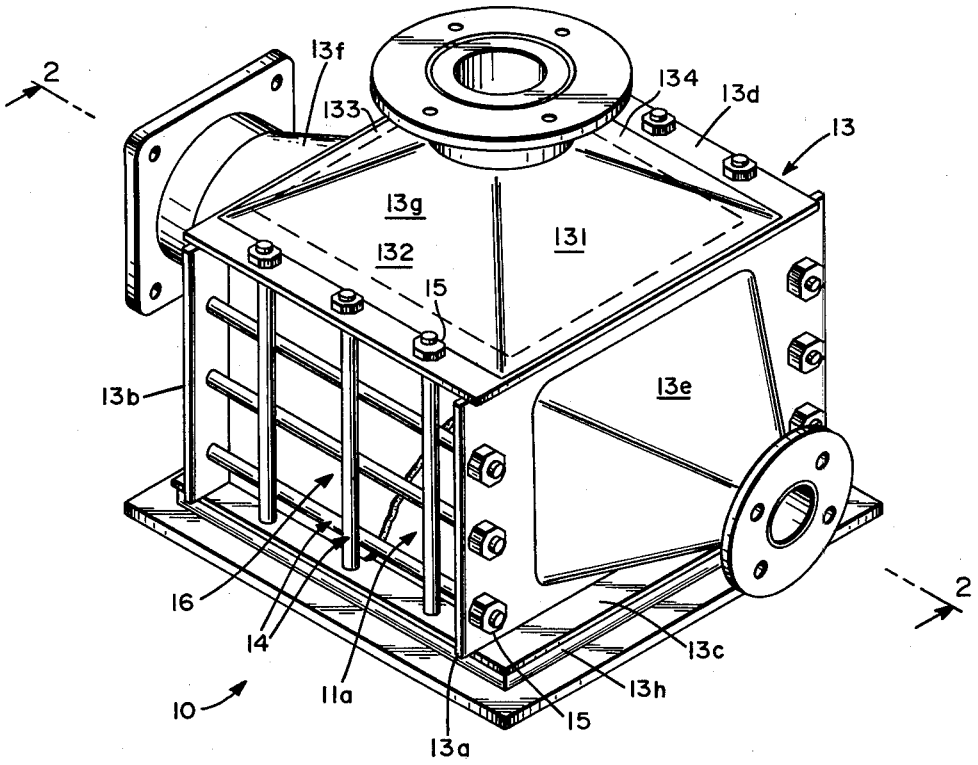
FIG. 1 is a perspective view of one embodiment of the heat recuperative apparatus of the invention, wherein the ceramic recuperator core and its housing are assembled.
Figure 3:
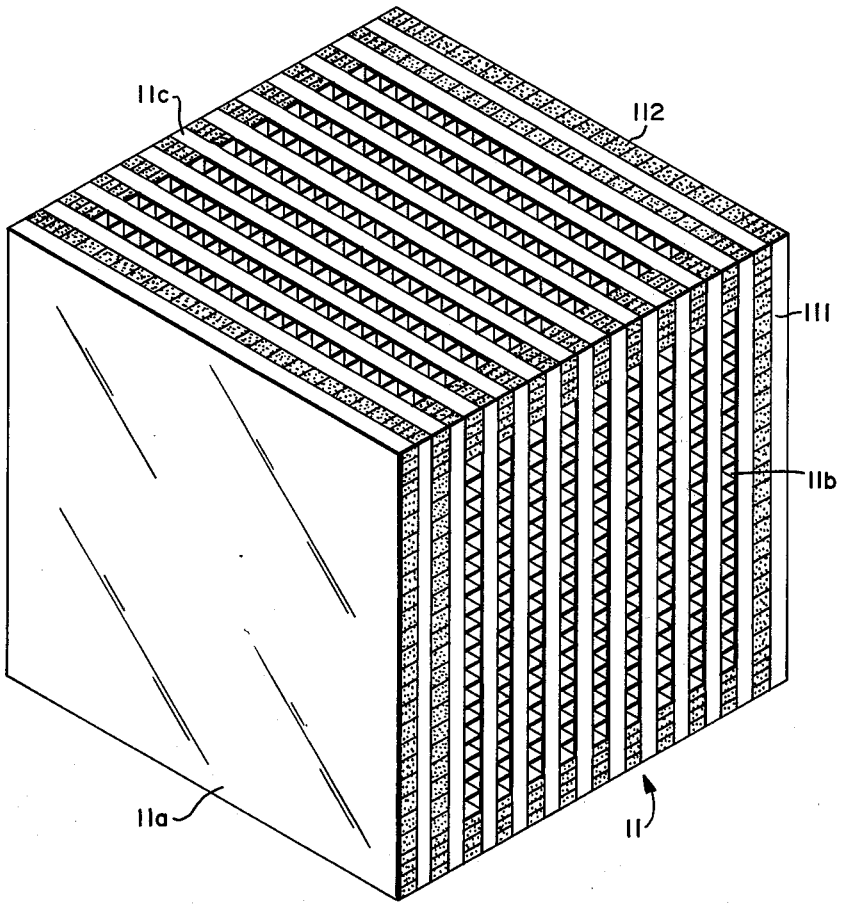
FIG. 3 is a perspective view of one embodiment of a ceramic cross-flow heat recuperative core of the apparatus of FIG. 1.

Referring now to FIG. 1 of the drawing, there is shown, in perspective, one embodiment of the recuperator assembly 10 of the invention, comprising a central core 11 of a ceramic cross-flow recuperator having first and second pairs of opposing faces defining cell openings for the passage of first and second heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid. The recuperator core is thus heated by the passage of hot exhaust gases through alternate layers of it, and incoming cold air or fuel is in turn preheated by the core as it passes through alternate layers of the core in the transverse direction. Such a structure in which ribbed sheets are stacked with ribs alternately transverse to one another is claimed in copending U.S. patent application Ser. No. 939,094, filed Sept. 1, 1978, and assigned to the present assignee. Some exemplary ceramic materials suitable for the fabrication of ceramic recuperators are mullite, zircon, magnesium, aluminum silicate, porcelain, aluminum oxide and silicon nitride. The metal housing 13 is comprised of two pairs of opposing apertured plates, 13*a* and 13*b*, and 13*c* and 13*d*. These pairs are held in firm contact with the faces of the ceramic core 11 by a plurality of elongated bolts 14 and nuts 15. The bolts traverse core 11 in proximity to the two solid faces (11*a* is shown). The remaining four faces of core 11 define the openings of the cells formed by the ribs and are designated the operating faces (11*b* and 11*c* are shown in FIG. 3). Access to these faces is through tapered flanged conduits 13*e*, 13*f* and 13*g*, and flanged conduit 13*h* in plates 13*a*, 13*b*, 13*d* and 13*c*, respectively.

The metal housing 13 may be formed from castings, or from machined and/or welded parts, and is preferably of a corrosion resistant metal such as stainless steel in corrosive applications and above 600° F. housing skin temperature.

Figure 2:
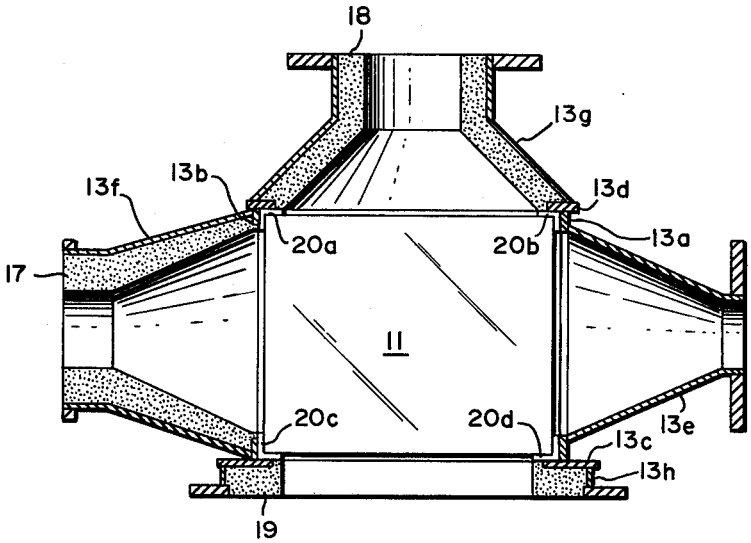
FIG. 2 is a section view of the assembly of FIG. 1.

Referring now to FIG. 2, there is shown a section view of the assembly of FIG. 1, wherein tapered flanged conduits 13*f* and 13*g*, and flanged conduit 13*h* are lined with ceramic insulating layers 17, 18 and 19 respectively. In operation, flue gas at a relatively high temperature, e.g., 2,400° F., enters the recuperator through flanged conduit 13*h*, heats the ceramic walls and exits through tapered conduit 13*g*. Insulating layer 18 inside conduit 13*g* maintains the temperature of the outer surface of conduit 13*g* at a relatively low temperature, e.g., about 400° F. Such structure enables placement of these assemblies near pedestrian traffic areas without undue safety hazards due to inadvertent contact therewith.

It will be seen that plates 13*c* and 13*d* are slightly oversized to extend beyond the edges of core 11 and plates 13*a* and 13*b*. In addition, conduits 13*g* and 13*h* join plates 13*c* and 13*d* near the outer edges thereof in order to accommodate substantial thicknesses of ceramic insulation without unduly restricting the access opening to the faces of core 11. It will be seen from FIG. 1 that sides 131 and 133 of conduit 13*g* are joined near the outer edges of apertured plate 13*d*, adjacent sides 132 and 134 are joined a short distance away from the edges of the plate. Such an arrangement is necessary in order to accommodate bolts 14 and nuts 15 adjacent to the sides 132 and 134. However, still referring to FIG. 1, it will be seen that plate 13*d* may be extended beyond the edges of core 11 in order to accommodate significant thicknesses of ceramic insulation without unduly restricting the access opening.

It should be understood that the above explanation applies also to the structure of plate 13*c* and conduit 13*h*.

Still referring to FIG. 1, the incoming air for combustion enters through conduit 13*e*, passes through core 11 to pick up heat stored in the ceramic cell walls, and exits through conduit 13*f*. In order to minimize loss of the picked-up heat to metal conduit 13*f*, a ceramic insulating layer 17 lines the inner surface thereof. The joinder of conduit 13*f* to plate 13*b* is similar to that of conduit 13*g* to plate 13*d* and 13*h* to 13*c*. That is, the conduit is joined to the plate near the outer edge thereof adjacent to plates 13*c* and 13*d*, but some distance away from the outer edge in the transverse direction to accommodate bolts 14. However, the extension of plates 13*c* and 13*d* beyond the edge of plate 13*b* prevents a similar extension of plate 13*b*. Thus, in order to maximize the access to core 11, ceramic insulating layer 17 is tapered in decreasing thickness toward core 11.

As shown in FIG. 3, core 11 has an outer border of cells (111 and 112 shown) of each operating face (11*b* and 11*c* shown) sealed with a ceramic cement in order to minimize leakage of the heat transfer fluids and provide further insulation against heat loss. In addition, as shown in FIG. 2, thin layers of a sealing means such as ceramic cement 20*a*, 20*b*, 20*c* and 20*d* are located at the areas of contact between the core and the housing plates to provide additional sealing.

Figure 4:
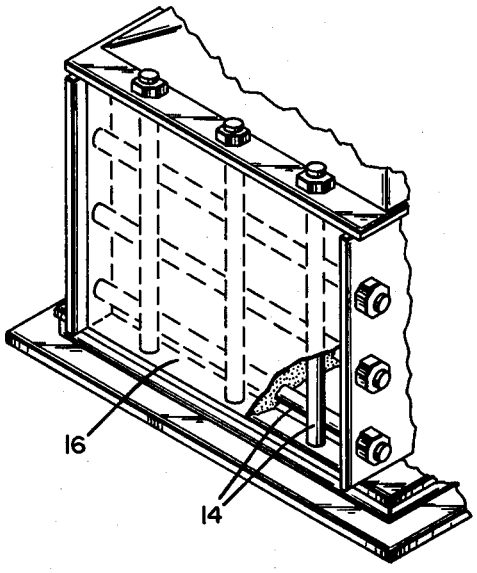
FIG. 4 is a perspective view, partly cut away, of a portion of an apparatus similar to that of FIG. 1 except that a ceramic insulating layer covers the bolts.

Again referring to FIG. 1, layers of ceramic insulation 16 are located on the solid faces (11*a* shown) of core 11 behind bolts 14, in order to minimize loss of heat from these otherwise exposed faces. In another embodiment, shown in FIG. 4, a thicker insulating layer 16 of a moldable ceramic composition encapsulates bolts 14. Typical ceramic moldable compositions suitable for use in forming any of the insulating layers described herein are Fiberfrax and LDS Moldable, tradenames of the Carborundum Co. Such moldable compositions are usually based upon a fiber blanket or chopped fibers of mullite ($3Al_2O_3 \cdot 2SiO_2$ mixed with a liquid cement such as one or more alkali metal silicates. Other suppliers of such compositions include Johns-Manville and Babcock & Wilcox. In addition to formation from a moldable composition, such insulating layers could also be formed as pre-cast inserts, or cast in-situ. Layers 17 and 18 are particularly suited to be formed as pre-cast inserts, while sealed borders 111 and 112 of core 11 could be cast in-situ.

Suitable materials for formation of cast ceramic inserts or for casting in-situ are castable compositions of alumina, zircon, mullite and zirconia. Typical castable compositions have two particle size distributions, a very coarse ranging typically from 6 to 10 mesh, and a very fine ranging typically from 325 mesh to less than one micron, with from 50 to 75 weight percent coarse, remainder fine. Setting is by loss of water of hydration. Other castable compositions are single particle size distribution systems, and typically rely on a phosphate for setting.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The heat recuperative apparatus described herein employing a ceramic cross-flow recuperative core is useful on a variety of industrial heating apparatus such as furnaces, ovens, calciners and preheaters where it is desired to recover waste heat losses from combustion and to use such waste heat to preheat incoming air and/or fuel for combustion. Retrofitting of such heat recuperative apparatus onto existing furnaces, etc., can result in significant fuel savings.

I claim:

1. A heat recuperator assembly comprising:

(a) a core of a cross-flow ceramic recuperator having first and second pairs of opposing faces defining cell openings for the passage of first and second heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid;

(b) a metallic housing surrounding the core, the housing having apertured faces adjacent the operating faces of the core;

(c) at least three conduit portions extending from the apertured faces, at least one of the conduit portions being tapered and having at least one dimension of its largest cross-section larger than the aperture of the apertured face from which it extends and having a substantial thickness of insulating means on its inner surface which does not decrease the size of the aperture of said apertured face; and (d) the internal metal surfaces of the assembly being insulated so that the first fluid contacts only insulation in passing through the assembly.

2. The assembly of claim 1 wherein at least one of the ceramic layers is of decreasing thickness in a direction toward the housing face, thereby to accommodate a substantial thickness of the ceramic layer in a direction away from the housing face without unduly restricting flow of the heat transfer fluid past the ceramic core face.

3. The assembly of claim 1 wherein at least a portion of each of three of the conduit portions is tapered in a decreasing cross-section in a direction away from the housing face.

4. The assembly of claim 1 wherein the housing comprises:

(a) two pairs of opposing apertured plates having opposing inner faces for contact with the hot and cold operating faces of the core, (b) conduit means extending from the outer faces of the plates, (c) means for coupling the conduit means to external fluid conduits, and (d) means for holding the inner faces in contact with the core operating faces.

5. The assembly of claim 4 wherein the holding means comprises two sets of a plurality of elongated bolts and nuts, the bolts of each set extending between opposing pairs of plates.

6. The assembly of claim 5 wherein thermal insulating means are provided for the outer solid faces of the core adjacent the holding means.

7. The assembly of claim 6 wherein the insulating means encapsulates the holding means.

8. The assembly of claim 1 in which a sealing means is provided between the ceramic recuperator faces and the apertured housing faces.

* * * * *